US009227770B2

(12) United States Patent
Lamoureux et al.

(10) Patent No.: US 9,227,770 B2
(45) Date of Patent: Jan. 5, 2016

(54) PLUG FOR CLOSING THE NECK OF A CONTAINER

(71) Applicant: Tetra Laval Holdings & Finance S.A., Pully (CH)

(72) Inventors: Richard Lamoureux, Rawdon (CA); Grégory Antier, Trévoux (FR)

(73) Assignee: Tetra Laval Holdings & Finance S.A., Pully (CH)

( * ) Notice: Subject to any disclaimer, the term of this patent is extended or adjusted under 35 U.S.C. 154(b) by 0 days.

(21) Appl. No.: 14/389,395

(22) PCT Filed: Mar. 7, 2013

(86) PCT No.: PCT/EP2013/054551

§ 371 (c)(1),
(2) Date: Sep. 30, 2014

(87) PCT Pub. No.: WO2013/149783

PCT Pub. Date: Oct. 10, 2013

(65) Prior Publication Data

US 2015/0060388 A1 Mar. 5, 2015

(30) Foreign Application Priority Data

Apr. 2, 2012 (FR) ..... 12 53002

(51) Int. Cl.

| | |
|---|---|
| ***B65D 47/36*** | (2006.01) |
| ***B65D 41/20*** | (2006.01) |
| ***B67D 3/00*** | (2006.01) |
| ***B65D 41/40*** | (2006.01) |

(52) U.S. Cl.

CPC ..... *B65D 47/36* (2013.01); *B65D 41/20* (2013.01); *B65D 41/40* (2013.01); *B67D 3/0032* (2013.01); *B67D 3/0061* (2013.01)

(58) Field of Classification Search

CPC ..... B65D 41/48; B65D 41/46; B65D 41/40; B65D 47/36; B65D 39/0023; B65D 39/0005; B65D 41/20; B67D 3/0061; B67D 3/0032

USPC ..... 215/228, 254, 253, 250, 320, 317, 364, 215/355; 220/270, 266, 265, 260, 212

See application file for complete search history.

(56) References Cited

U.S. PATENT DOCUMENTS

| | | | | |
|---|---|---|---|---|
| 3,392,862 | A * | 7/1968 | Faulstich | 215/254 |
| 4,303,167 | A * | 12/1981 | Martinez | 215/256 |
| 4,545,497 | A | 10/1985 | Martha, Jr. | |
| 4,577,771 | A * | 3/1986 | Martinez | 215/256 |
| 5,687,865 | A | 11/1997 | Adams et al. | |

OTHER PUBLICATIONS

International Search Report in PCT/EP2013/054551, mailed May 21, 2013 (3 pages).

* cited by examiner

*Primary Examiner* — Robert J Hicks

(74) *Attorney, Agent, or Firm* — Finnegan, Henderson, Farabow, Garrett & Dunner, L.L.P.

(57) ABSTRACT

A plug for closing a neck of a container comprises an obturation cap, which is laid out across an inner aperture of the neck of the container and which is crossed by a driving-in member notably when the container is installed on a dispenser, and a skirt for attachment to the neck, centered on an axis. The cap defines a central cavity for receiving the driving-in member, the bottom region of which is delimited by a breakable part, which is adapted to be set in abutment by the driving-in member until it breaks and which includes a central bottom wall and a side wall provided with breaking lines extending radially to the axis, while the remainder of the cavity is delimited by a tubular part of the cap, which guides the driving-in member.

13 Claims, 8 Drawing Sheets

PLUG FOR CLOSING THE NECK OF A CONTAINER

CROSS-REFERENCE TO RELATED APPLICATIONS

This is a U.S. National Phase of PCT/EP2013/054551, filed Mar. 7, 2013, which claims the benefit of priority to French Patent Application No. 1253002, filed Apr. 2, 2012, which is incorporated herein by reference.

The present invention relates to a plug for closing the neck of a container.

The invention in particular addresses the case of containers consisting of a carboy of liquid, capable of containing at least about ten liters of liquid, notably water, typically water carboys of three, four or five gallons, which are used in the upside down position in dispensing fountains or similar devices. The neck of these carboys, which is therefore turned downwards when the carboy is installed on a water dispenser, is closed by a plug generally described as a <<snapped-on>> plug, i.e. a plug for which the tubular skirt is able to be interiorly clipped or more generally coaxially blocked around the neck, unlike screwed plugs for example. This skirt extends axially from a cap of the plug, which obturates the neck and which is designed so as to be crossed right through by a driving-in member belonging to the dispenser.

In order to facilitate the placement of this driving-in member through the cap of the plug, it is known, for example from U.S. Pat. No. 5,687,865 on which the preamble of appended claim 1 is based, how to provide the cap with a central cavity, which is dimensioned so as to receive the driving-in member, by guiding it until the free end of this member will abut against a breakable part, with the shape of a smooth cone frustum with a convex central bottom, of the wall of the cavity: a weakening line, which runs as a straight line on a lateral side of the conical wall of this breakable part to the other lateral side, while passing through the central bottom, then breaks under the action of driving in the member, the progression of the latter through the cap may then be continued until a liquid circulation is established between the inside and the outside of the plug, via the driving-in member generally provided as a hollow member for this purpose. U.S. Pat. No. 5,687,865 makes provision for having the end of the driving-in member bear axially against a rib protruding from the central bottom of the breakable part of the cap, this rib extending in length from the weakening line and perpendicularly thereto. Considering this perpendicular layout between the rib and the weakening line, the effect of this rib on the breaking of the weakening line is limited: this is only an initiation of this breakage, localized at the center of the weakening line. The benefit of this initiation is therefore small, or even insignificant as regards the global force which has to be produced for having the driving-in member pass right through the cap. Further, it is understood that the relevance of this rib is greatly dependent on the shape of the free end of the driving-in member: indeed, if the driving-in member actually used has a less convex end than the one envisioned in U.S. Pat. No. 5,687,865, it is not excluded, or even it is probable that the weakening line begins to break under the action of the driving-in member even before the end of the latter comes into contact with the rib. Now, in practice, very many different shapes are found on the market as regards the driving-in member of water dispensers.

The object of the present invention is to improve the plugs of the type mentioned above, by significantly limiting the force required for driving them in, and this for a large diversity of shapes of the free end of the driving-in member used.

For this purpose, the object of the invention is a plug for closing the neck of a container as defined in claim 1.

One of the ideas at the basis of the invention is to seek, regardless of the specific shape of the free end of the driving-in member, to concentrate on the breaking lines the bearing stresses of this end on the breakable part of the cap. According to the invention, provision is made on the side wall which is notably at least partly frustoconical, of the breakable part, for raised portions protruding from the face of this wall turned towards the cavity, in other words turned towards the free end of the driving-in member, so that this end essentially bears, or even exclusively bears on these raised portions or protrusions, in particular the furthest end comes into contact with the bottom wall of the breakable part. Each of these protrusions thus allows a contact interface to be established with the driving-in member, which, according to the invention has an elongated global shape, globally extending along one of the breaking lines, with which the side wall of the breakable part is provided: to do this, each of these protrusions runs over one of the two longitudinal sides of one of the breaking lines, globally following this longitudinal side. In this way, at the moment when the end of the driving-in member begins to bear on this protrusion, it induces a concentration of stresses on the line, notably tensile and/or torsional stresses, which facilitates breakage of the line and then as the driving in of the member is gradually continued, the end of the driving-in member continues to act on the protrusion by displacing its bearing area along the protrusion, which efficiently causes progression of the breakage of the line along the latter. The force required for complete breakage of the line thus proves to be significantly reduced, and this all the more so since the resistant frictional effects between the driving-in member and the side wall of the breakable part are limited by the small extent of their frictional contact. Advantageously, with the invention, it is thus possible to cause the tearing of the breaking lines essentially or even exclusively under the effect of the weight of the container when the latter is full, typically at the moment when the latter is installed in the upside down position on a dispenser, with upward engagement of the driving-in member of the latter into the inside of the cavity of the cap of the plug for closing this container. The performances of the invention are such that, while guaranteeing breakage of the breakable part of the cap under the effect of the weight of the container, as explained above, the breaking lines may be reinforced, which thus facilitates handling of the plug in order to put it initially in place on the neck of the container, and which limits the risks of leaks through these breaking lines.

Additional advantageous features of the plug according to the invention are specified in the dependent claims.

The invention will be better understood upon reading the description which follows, only given as an example and made with reference to the drawings wherein.

Figure 1:
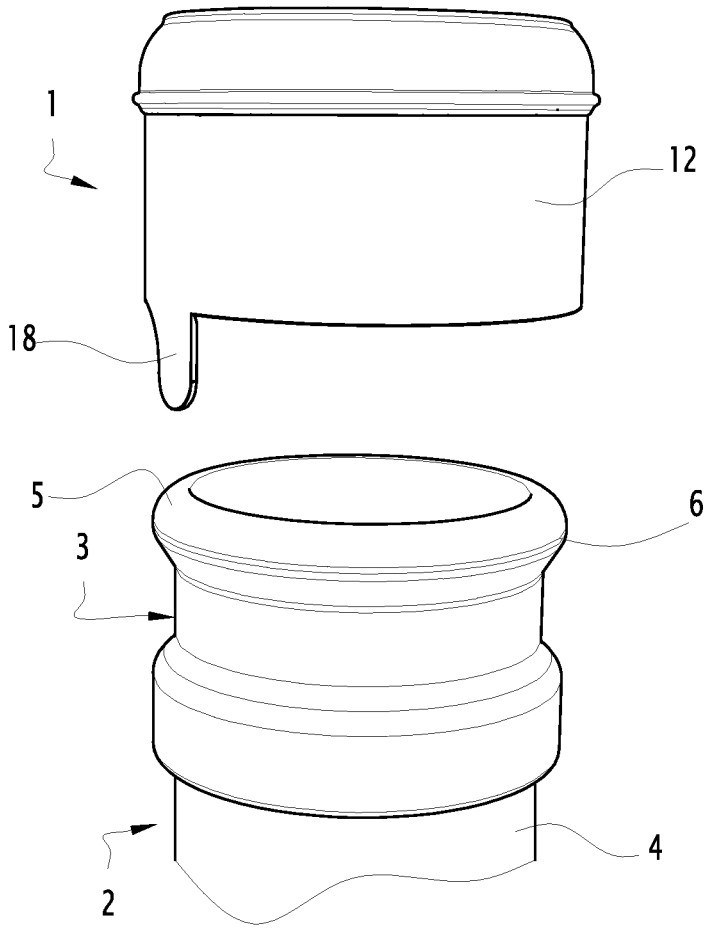
FIG. 1 is an exploded perspective view of a plug according to the invention and of a neck of a container able to be closed by the plug.

In FIGS. 1 to 9, is illustrated a plug 1 able to close the neck 3 of a container 2.

Generally, the neck 3 is either made in the same material with the remainder of the container 2, notably when the latter is a glass or plastic container, or adapted so as to be permanently secured on a wall of the container 2, at an aperture crossing this wall. As discussed in the introductory portion of the present document, the container 2 is preferentially a carboy containing at least about ten liters of liquid, notably a water carboy having a capacity of three, four or five gallons.

The neck 3 has a globally tubular shape, the central longitudinal axis of which is referenced as X-X. By convenience, the following of the description of the plug 1 is oriented relatively to the axis X-X, by considering that the terms of <<lower>> and <<bottom>> describe a portion of the plug which is directed axially towards the main body of the container 2 when the plug 1 obturates the neck 3 of this container and while the latter lies on a horizontal plane, such as table, with its neck 3 directed upwards, as in FIGS. 1, 2 and 4. Conversely, the terms of <<upper>> and <<top>> correspond to an axial direction of opposite sense. Also, the term of <<inner>> describes a portion of the plug 1 which is transversely directed towards the axis X-X, while the term of <<outer>> corresponds to a transverse direction of opposite sense.

The neck 3 includes a globally tubular body 4, with a circular base and centered on the axis X-X. The top axial end 5 of the body 4 is free, while being open on the outside, while, at its opposite axial end, the body 4 opens into the main body (not shown) of the container 2. The free end 5 of the body 4 connects with each other the inner and outer faces of this body. The outer face of the body 4 is provided with an upper peripheral heel 6 protruding outwards.

Figure 2:
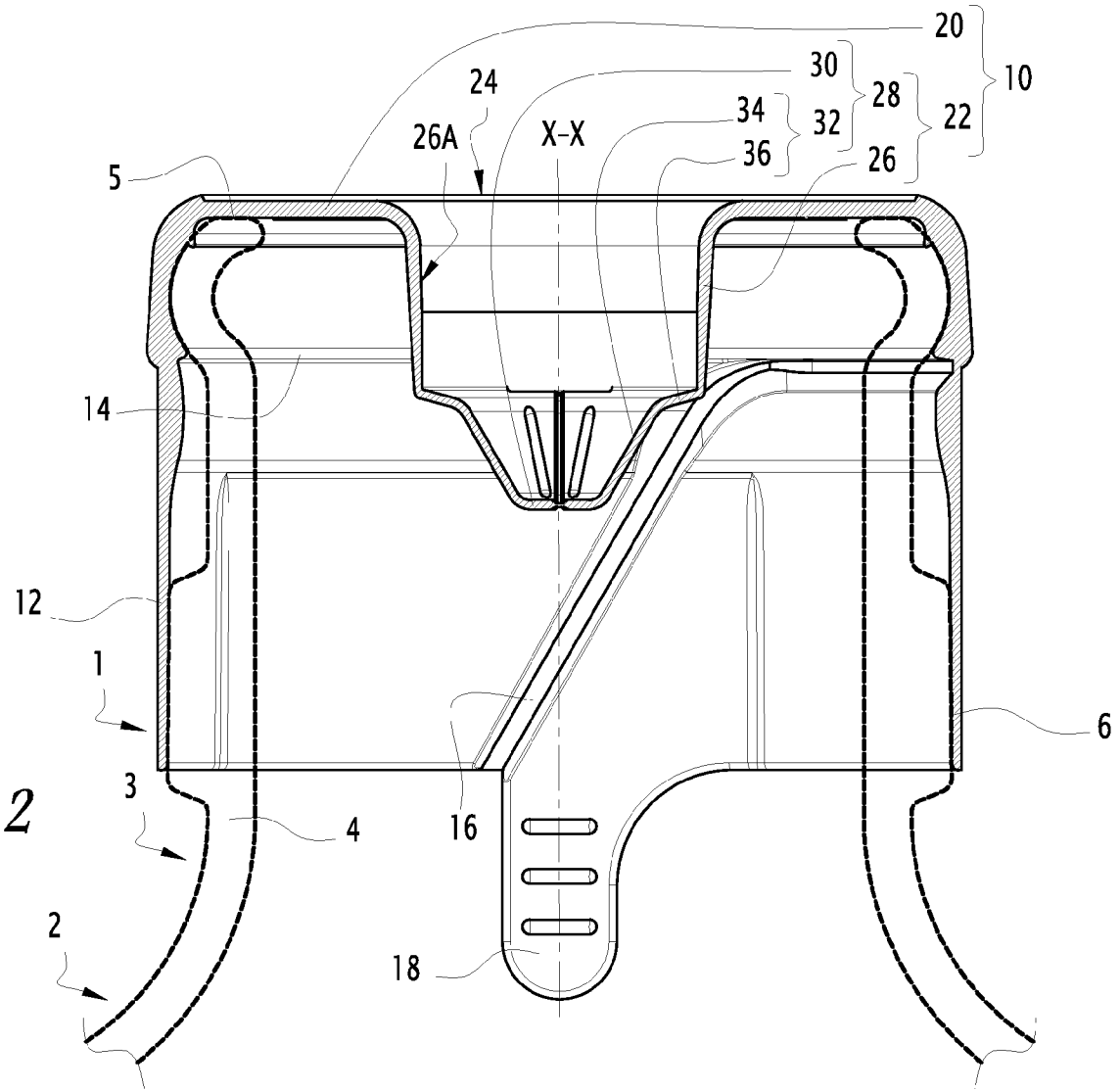
FIG. 2 is a longitudinal section view of the plug of FIG. 1, in a configuration for closing the neck, the latter only being indicated in dotted lines.
Figure 6:
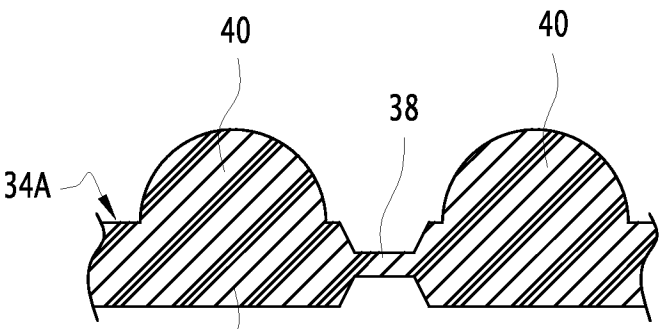
FIG. 6 is a section along the line VI-VI of FIG. 4.
Figure 3:
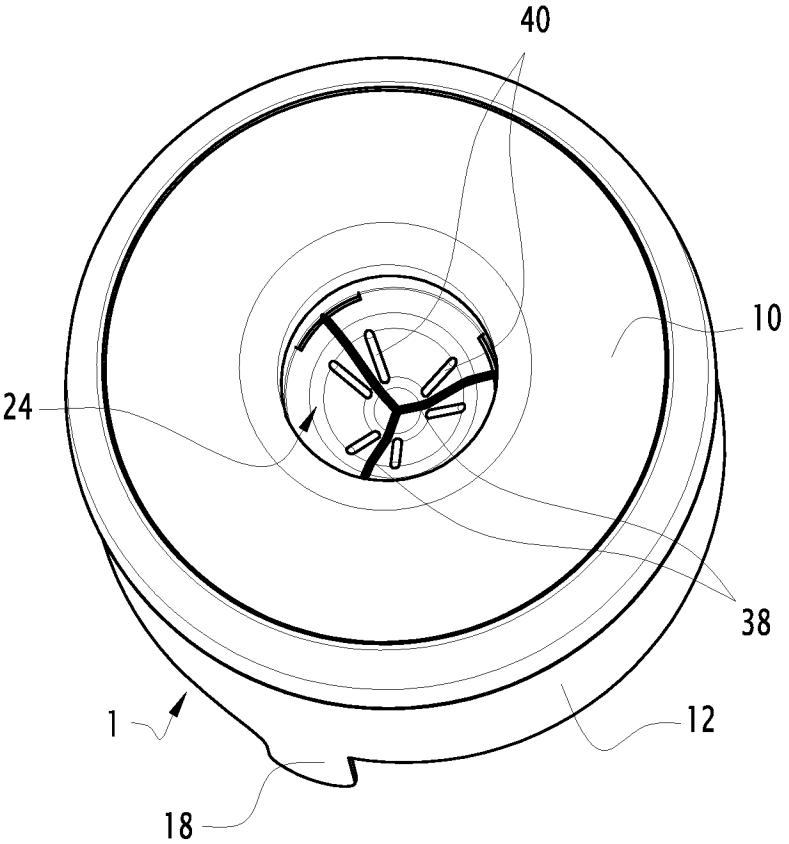
FIG. 3 is a perspective view of the plug of FIG. 1.

As this is well visible in FIGS. 1 to 3, the plug 1 has a globally tubular shape, the central longitudinal axis coincides with the axis X-X of the neck 3 when the plug 1 is set into place on the neck. The plug 1 is open at its lower end and closed at its upper end by a cap 10 which, when the plug 1 is in a closing configuration on the neck 3, as shown in dotted lines in FIG. 2, is laid out through the inner aperture of the neck so as to obturate the latter.

At the outer periphery of the cap 10, a globally tubular skirt 12 extends downwards, centered on the axis X-X and with a circular base, having been made with the cap in the same material.

As this is well visible in FIG. 2, the skirt 12 is, in its top portion, provided with a bulging line 14, which protrudes towards the interior of the inner face of the skirt and which runs over the whole periphery of the skirt. This bulging line 14 is designed in order to cooperate by diametrical interference with the heel 6 of the neck 3 for attachment purposes by jamming the skirt 12 coaxially around the neck when the plug 1 is in a closing configuration on this neck, as shown in dotted lines in FIG. 2. In the embodiment considered in the figures, the bulging line 14 runs over the inner periphery of the skirt 12 without any interruption. Of course, as an alternative not shown, the bulging line may be provided as discontinuous over the inner periphery of the skirt portion 21, while being regularly interrupted, which amounts to stating that this bulging line then consists of a succession of bulging portions, distributed along the periphery of the inner face 21A of the skirt portion 21.

The skirt 12 is moreover provided with a weakening line 16 designed so as to be broken under the action of the user, in order to separate the portions of the skirt 12 from each other, which were initially connected with each other through this weakening line 16. In practice, it is understood that the weakening line 16 is broken by a user when the latter wishes to free the plug 1 in totality relatively to the neck 3 of the container 2, notably for purposes of reusing this container. As an exemplary embodiment, this weakening line 16 includes a first portion, which is located at a substantially constant axial level of the skirt 12 and which runs over a portion of the periphery of this skirt along the bulging line 14 on the one hand and a second portion which connects the first portion of the weakening line to the free lower end of the skirt 12 on the other hand. Advantageously, the lower end of the skirt 12 is provided with a tab 18 protruding downwards, in close proximity to the second portion of the weakening line 16: in a way known per se, this tab 18 is provided so as to be grasped by the fingers of the user in order to be moved away from the neck 3 of the container 2, which induces initiation of tearing at the free end of the second portion of the weakening lines 16.

Figure 4:
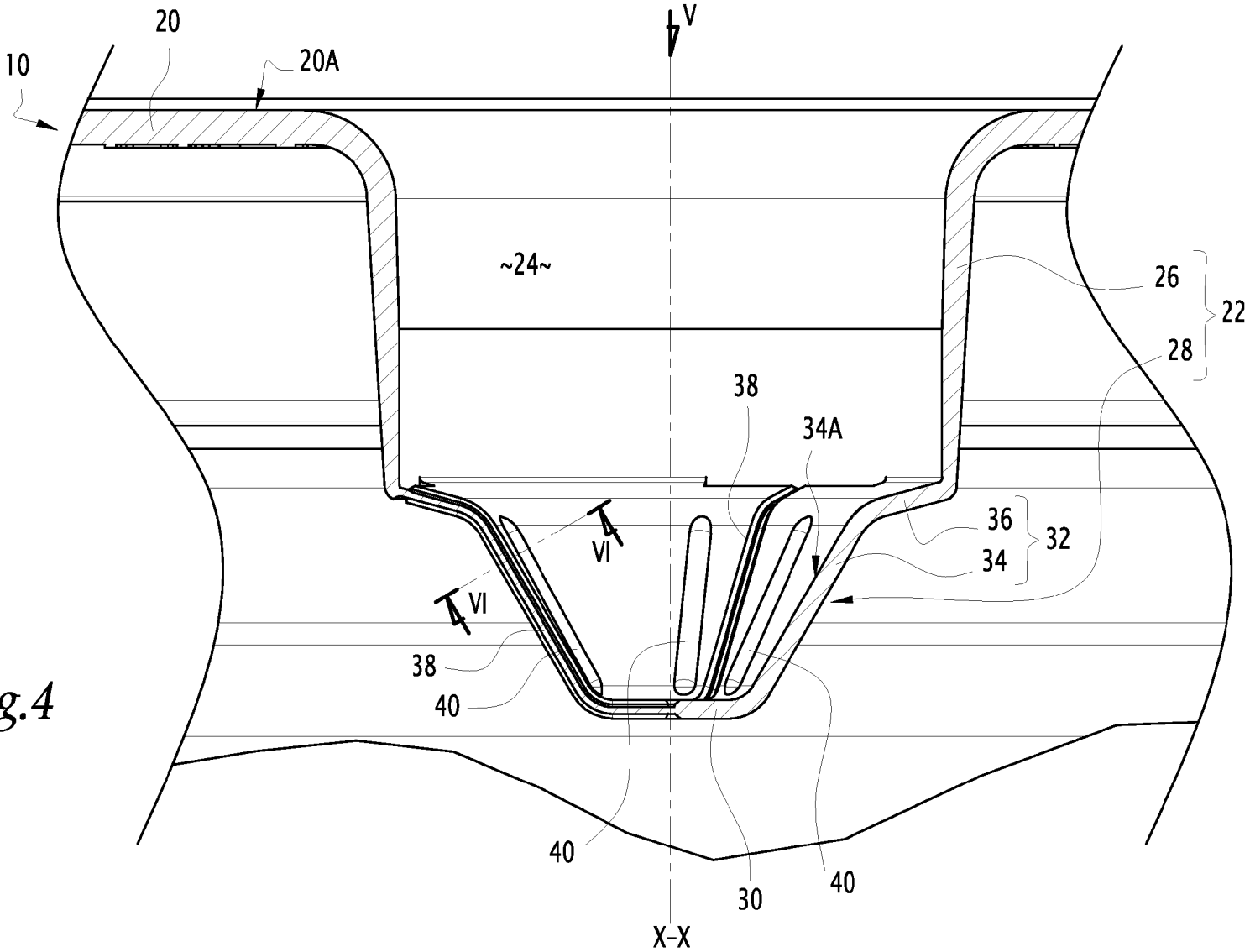
FIG. 4 is a partial longitudinal sectional view of the plug of FIG. 1, at a larger scale than that of FIG. 2 and produced in a sectional plane perpendicular to the one of FIG. 2.

Now returning to the description of the cap 10 of the plug 1, FIGS. 2 to 4 actually show that the outer peripheral portion 20 of this cap is globally planar, while being advantageously included in a plane substantially perpendicular to the X-X axis. The skirt 12 is made in the same material with the outer periphery of this peripheral portion 20 of the cap 10, while extending axially downwards from the latter.

Figure 7:
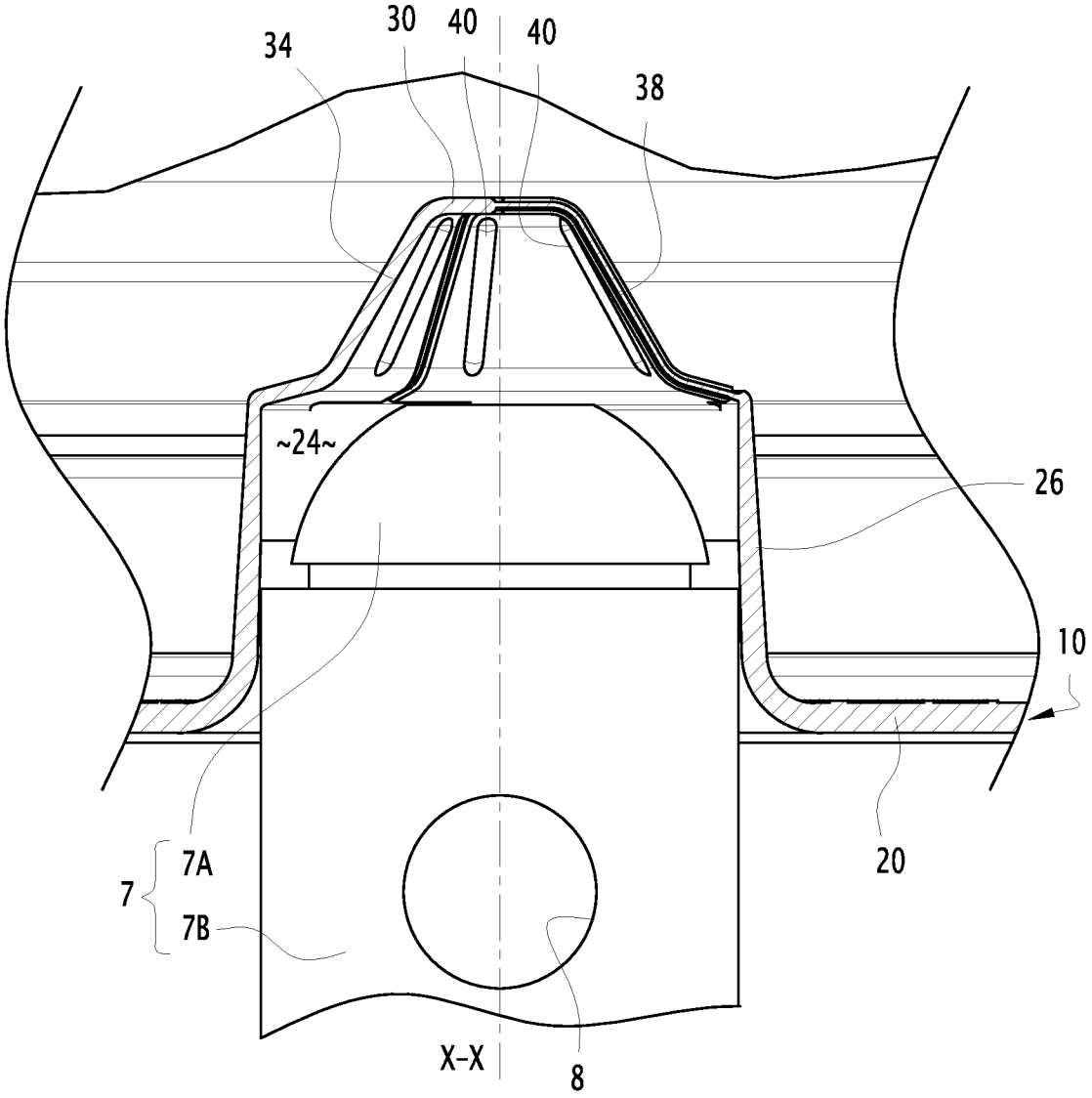
FIGS. 7 to 9 are views similar to FIG. 4, respectively illustrating successive steps for placing a driving-in member through the plug.
Figure 8:
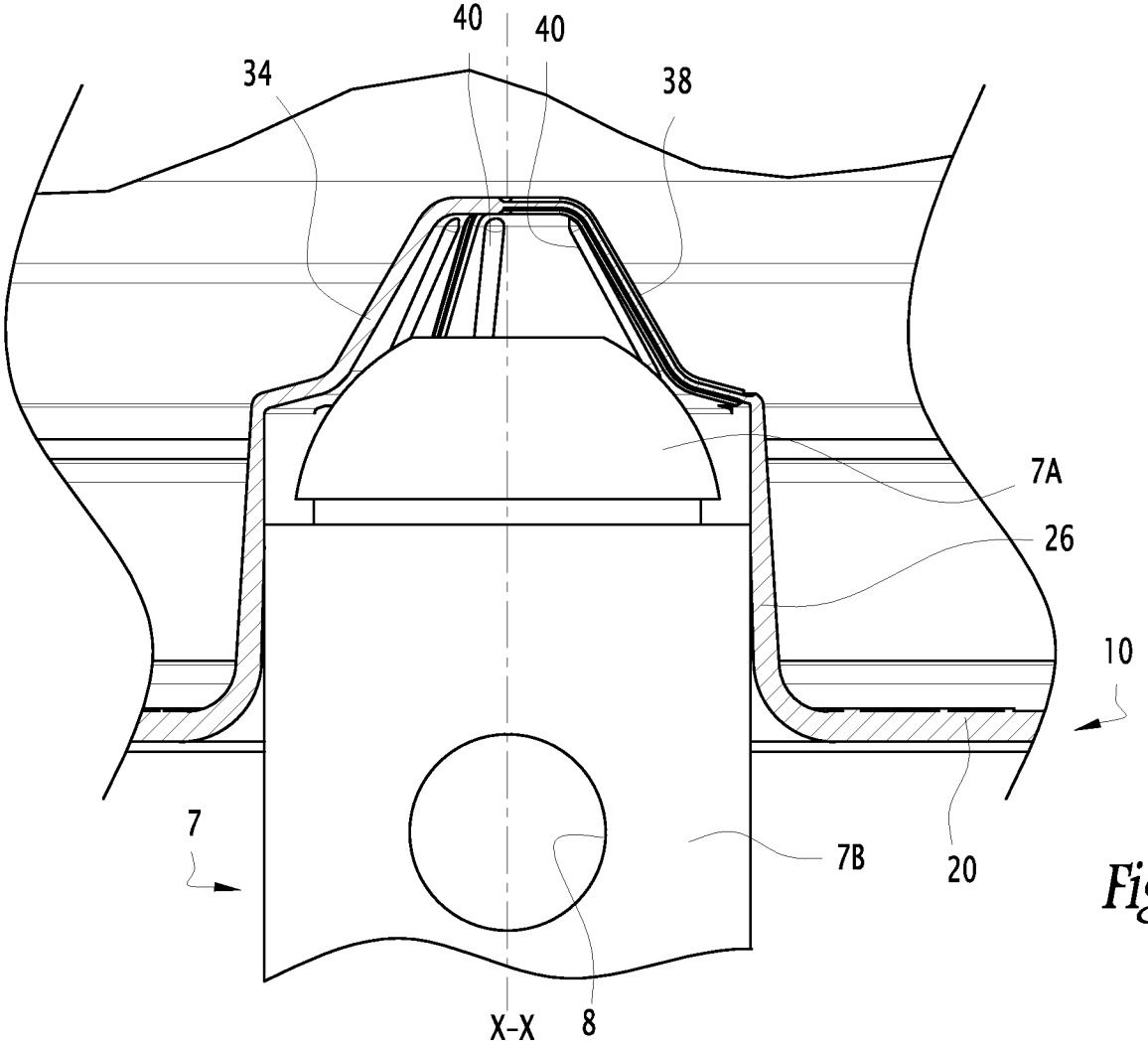
Figure 9:
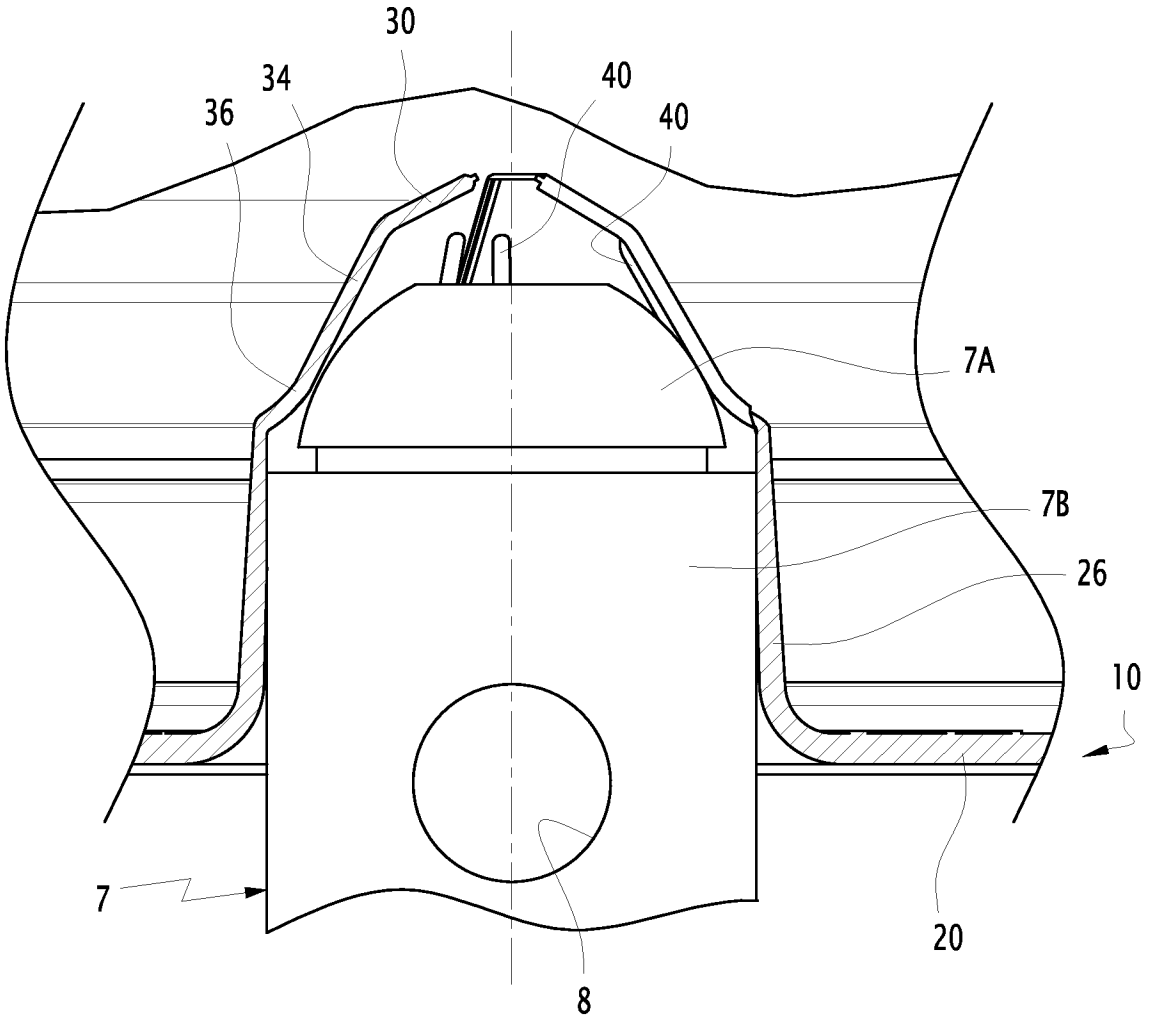

The inner peripheral portion 22 of the cap 10, as for it, has a hollow shape relatively to the upper face 20A of the outer peripheral portion 20: the cap 10 thus defines, by its inner peripheral portion 22, a cavity 24, which is globally centered on the axis X-X and which, as this will be detailed later on with reference to FIGS. 7 to 9, is designed for receiving and more generally cooperating with an axial driving-in member 7 of the cap 10.

As this is well visible in FIGS. 3 and 4, the inner portion 22 of the cap 10 comprises a tubular wall 26, which is substantially centered on X-X and which extends axially downwards from the inner periphery of the outer peripheral portion 20 of the cap 10, while being advantageously made in the same material with this portion 20. The tubular wall 26 thus forms the upper part of the inner portion 22 of the cap 10. Further, this tubular wall 26 is thus located on the same axial side of the outer peripheral portion 20 of the cap 10 as the skirt 12, while being laid out coaxially inside the latter. The inner face 26A of the tubular wall 26, which, in the exemplary embodiment considered here, is essentially cylindrical with a circular base centered on the axis X-X, delimits all the upper axial portion of the cavity 24, i.e. the axial portion of this cavity which opens upwards on the outside of the plug 1, more specifically on the upper face 20A of the outer peripheral portion 20 of the cap 10. Advantageously, for reasons which will become apparent later on, the inner face 26A of the tubular wall 26 connects to the upper face 20A of the outer portion 20 of the cap 10 following a continuous curved profile, as this is well visible in FIG. 4.

The inner portion 22 of the cap 10 also comprises a lower portion 28, which extends downwards from the lower end of the tubular wall 26 and which delimits the bottom axial portion of the cavity 24 by closing the latter downwards, which amounts to stating that this lower portion 28 of the cap 10 delimits the bottom region of this cavity 24.

Figure 5:
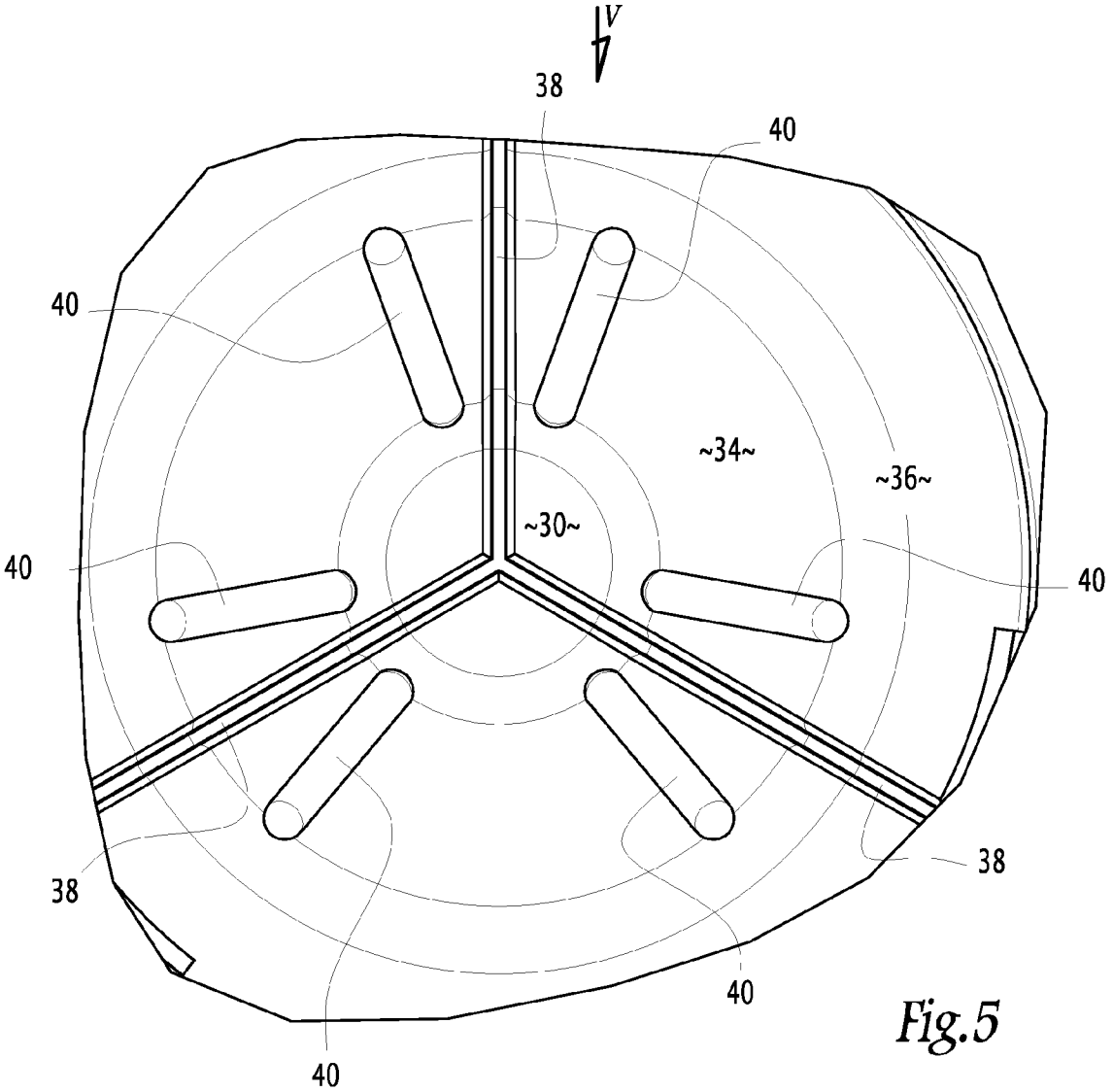
FIG. 5 is an elevational view along the arrow V of FIG. 4.

As this is well visible in FIGS. 3 to 5, this lower portion 28 includes, at its bottom end, a bottom wall 30, which is crossed right through by the axis X-X and which, in the exemplary embodiment considered in the figures, essentially consists in a discoidal wall, centered on the axis X-X and globally included in a plane perpendicular to this axis X-X. The lower portion 28 also includes a side wall 32 which extends all around the axis X-X and which, according to the direction of this axis, connects the bottom wall 30 and the tubular wall 26, while being advantageously made in the same material with the latter. More specifically, the side wall 32 extends upwards from the outer periphery of the bottom wall 30, until it joins up with the lower end of the tubular wall 26, by gradually increasing its radial distance from the axis X-X.

In the exemplary embodiment considered in the figures, the side wall 32 includes a main frustoconical part 34, which is substantially centered on the axis X-X and converges towards the bottom wall 30, and the lower end of which is joined with the outer periphery of the bottom wall 30 while the upper end of this frustoconical part 34 is connected to the lower end of the tubular wall 26 through a globally annular connecting portion 36, centered on the axis X-X and slightly tilted downwards upon moving away from the tubular wall 26.

The lower portion 28 of the lower peripheral portion 22 of the cap 10 is breakable, in the sense that this lower portion 28 is provided with weakening lines 38 which are three in number in the exemplary embodiment considered in the figures and which are designed for breaking so as to separate portions of the part 28 from each other which were initially connected with each other through these weakening lines 38. In practice, as explained in more detail in the following, these lines 38 are broken under the action of the driving-in member 7 when the latter is engaged through the cap 10. Advantageously, as this is well visible in FIGS. 3 to 5, each breaking line 38 extends from a lower end, located on the axis X-X, as far as an outer end, located at the junction between the lower portion 28 and the tubular wall 26, it being noted that, between its inner and outer ends, each breaking line 38 extends as a straight line, i.e. it extends radially to the axis X-X, in the sense that, in an orthogonal projection in a plane perpendicular to the axis X-X, this breaking line 38 extends from the axis X-X along a direction radial to this axis. Thus, each breaking line 38 runs, from its inner end to its outer end, in successively the bottom wall 30, the frustoconical part 34 and the connecting portion 36 as this is well visible in FIG. 5. Moreover, the three breaking lines 38 are distributed around the axis X-X, and this advantageously in a regular way, thereby distributing the breakable lower portion 28 into three portions in succession around the axis X-X.

As an advantageous option, the outer end of each breaking line 38 forms an arc centered on the axis X-X, which extends on either side of the breaking line, and this at the junction between the lower portion 28 and the tubular wall 26. As an alternative not shown, the upper end of the breaking line 38 is without the aforementioned arc, and only has a point-like profile, located in the rectilinear extension of the remainder of the breaking line.

Also as this is well visible in FIGS. 3 to 5, the frustoconical part 34 of the side wall 32 of the breakable part 28 is provided with ribs 40, which each protrude upwards from the upper face 34A of this frustoconical part, in other words from its face turned towards the cavity 24, and which each extend in a rectilinear way between the opposite axial ends of this frustoconical part 34. In the exemplary embodiment considered here, these ribs 40 are six in number, while being distributed in three pairs respectively associated with the three breaking lines 38, both ribs 40 of each of its pairs being located on either side, around the axis X-X, of the corresponding breaking line 38. Thus, as this is well visible in FIG. 6, each rib 40 forms a protruding raised portion of the upper face 34A of the frustoconical part 34, in other words protruding on the side of this face 34A in a direction opposite to which the wall thickness of the frustoconical part 34 is locally reduced or more generally weakened so as to form the breaking line 38 with which the relevant breaking line is associated. Further, as this is well visible in FIG. 5, each rib 40 runs in length globally along the breaking line 38 with which this rib is associated: more specifically, in the embodiment considered in the figures, each rib 40 thus extends in length, radially to the axis X-X, i.e. along a direction which, when the rib 40 is projected orthogonally in a plane perpendicular to the axis X-X, is radial to this axis. Thus, as this is well visible in FIG. 5, the orthoradial spacing between each rib 40 and its associated breaking line 38 gradually increases upon moving away from the axis X-X. As an alternative not shown, each rib 40 extends in length parallel to the breaking line 38 with which this rib is associated, which amounts to stating that in this case, the orthoradial distance between the rib and its associated breaking line is substantially constant upon moving away from the axis X-X.

In all the cases, according to an advantageous arrangement, each rib 40 is orthoradially distant from the breaking line 38 with which this rib is associated, and this over the whole length of this rib. This amounts to stating that each rib 40 is in totality laid out at a distance from its associated breaking line, notably without this rib 40 intersecting its associated breaking line or being joined up with it. In other words, the orthoradial spacing between each rib 40 and the associated breaking line 38 is advantageously non-zero in every point of this rib. One of the benefits of this advantageous arrangement is avoiding that the presence of the ribs 40 perturbs the propagation of a tear along the breaking line 38, notably for avoiding the breaking or the dispersion of the propagation of this tear.

In practice, notably for reasons of manufacturing, notably molding of a plastic material forming the plug 1 when the latter is made in one piece, and/or for reasons of mechanical behavior, both ribs 40 associated with a same breaking line 38 are laid out symmetrically with respect to this breaking line.

The benefit of the ribs 40 will now be explained, essentially with reference to FIGS. 7 and 9 which aim at illustrating the placement of the driving-in member 7 through the cap 10. In practice, it will be noted that this placement is achieved while the plug 1 is in place on the neck 3 and thus closes the container 2 and that this placement is very often achieved when the container 2 is upside down, i.e. with its neck 3 directed downwards, which explains the orientation of FIGS. 7 to 9. Further, in a non-limiting way to the present invention, this placement is concomitantly achieved with the installation of the container 2 on a dispenser, such as a fountain or a similar device, provided for being supplied with liquid contained in the container 2, via the driving-in member 7 after the latter has been passed through the cap 10. Thus, also in a non-limiting way to the invention, the driving-in member 7 has an elongated outer shape, the end 7A of which, opposite to the remainder of the aforementioned dispenser, is free, while being typically directed upwards, while the running portion 7B of the driving-in member 7 interiorly delimits a channel for circulation of liquid, connected downstream to the remainder of the dispenser and opening upstream on the outside of the driving-in member 7, via a side aperture 8. In practice, the free end 7A is constricted relatively to the running portion 7B, by being gradually shrinked upon covering this end 7A while moving away from the running portion 7B and along the longitudinal direction of the driving-in member 7: thus, in the example considered in FIGS. 7 to 9, the running portion 7B has a substantially cylindrical outer shape with a circular base, while the free end 7A has a globally hemispherical outer shape, the diametrical plane of which is connected to the running portion 7B by forming an interior shoulder relatively to the cylindrical outer surface of this running portion, and which is truncated opposite the aforementioned diametrical plane. As mentioned above, this shape of the driving-in member 7 is only an example of the outer geometry of such a driving-in member; various shapes compatible with the invention may be contemplated and are moreover found presently on the market.

In a first phase which is illustrated by FIG. 7, it is considered that the driving-in member 7 begins to be introduced into the inside of the cavity 24 defined by the cap 10 of the plug 1. To do this, the driving-in member 7 is aligned beforehand on the axis X-X, and the plug 1 and the member 7 are brought closer to each other axially so as to cause penetration into the inside of the cavity 24, of first the free end 7A of the driving-in member, and then its running portion 7B. With its adequate dimensioning, the inner face 26A of the tubular wall 26 receives the running portion 7B of the driving-in member 7 in a substantially snug way, thereby guiding the placement of this member through the cap 10, in particular the progression of its free end 7A towards the bottom region of the cavity 24. Advantageously, the curved profile connecting the inner face 26 to the upper face 20A of the outer peripheral portion 20 of the cap 10 facilitates, by sliding for centering, the introduction of the driving-in member 7 into the cavity 24.

By continuing the axial engagement of the driving-in member 7 into the cavity 24, its free end 7A moves closer to the breakable part 28 of the cap 10, until it comes into contact with this portion 28, as shown in FIG. 8. More specifically, as this is well visible in FIG. 8, the free ends 7A of the member 7 will then axially bear against the ribs 40, because of their protruding layout from the face 34A of the frustoconical part 34 of the aforementioned portion 28. In particular, due to their protruding nature, these ribs 40 form axial abutments for the free ends 7A of the driving-in member 7, against which this free end bears before interfering by direct contact with the bottom wall 30 of the breakable part 28. The bearing pressure of the driving-in member 7 on the ribs 40 concentrates on the breaking lines 38 the stresses applied by this driving-in member 7 on the plug 1, in the sense that the three respective segments of the line 38, located at the axial level of the contact interference between the free end 7A of the driving-in member 7 and the ribs 40, are subject to deformation stresses, notably tensile and torsional stresses, which essentially correspond to the totality of the pressing force transmitted from the driving-in member 7 to the plug 1. These deformation stresses are such that the three aforementioned segments of the breaking lines 38 easily break, notably exclusively under the weight due to gravity of the container 2 during installation of this container in an upside down position on the dispenser provided with the driving-in member 7, without the operator who sets this container into place, having to produce an additional force for driving the container downwards.

More generally, by means of the ribs 40, the force required for breaking the lines 38 is comparatively reduced as compared with the situation where these ribs 40 would be absent, and this by at least 10%, or even more. As explained above, this is because the ribs 40, which are the first areas of the plug 1 against which the driving-in member 7 bears, concentrate the bearing stresses to which they are subject, onto the breaking lines 38. This is also because the global pressing contact interface between the driving-in member 7 and the plug 1 is then restricted to the six ribs 40, which significantly limits the frictional resistances between the driving-in member 7 and the plug 1, in particular comparatively with the situation where the ribs 40 would be absent.

According to an advantageous arrangement illustrating the performances of the invention, it is possible to reinforce the resistance to breakage of the breaking lines 38, typically by limiting their weakening, which reinforces the mechanical strength of the plug 1 before its opening and consequently its leakproof performances, while guaranteeing that the force required for tearing these lines 38 under the action of the driving-in member 7 remains less than what would have been required to apply in the absence of the ribs 40, notably remains less than the force resulting from the weight of the container 2 when the latter has to be placed in an upside down position on the aforementioned dispenser. More generally, the possibility, which the invention provides, of somewhat allowing overdimensioning of the breakage resistance of the lines 38, facilitates the manufacturing of the plug, notably by limiting the molding stresses of these breaking lines.

Of course, what has just been described with reference to FIG. 8 is continuously reproduced as the breaking lines 38 break gradually and concomitantly, the free ends 7A of the driving-in member 7 covers the longitudinal extent of the ribs 40, while bearing against the latter, until the configuration shown in FIG. 9 is attained for example, in which the essential part, or even the quasi totality of the breaking lines 38 are broken. The progression of the driving-in of the member 7 through the cap 10 then leads to moving the free peripheral portions away from each other forming the breakable part 28, which were initially connected through the breaking lines 38 when the latter were entire. Advantageously, it will be noted that the ribs 40 have the additional benefit of moving apart radially outwards each of the three aforementioned portions, more than if these ribs were absent since, considering their protruding nature relatively to the face 34A of the frustoconical wall 34 and their longitudinal extent between the opposite axial ends of this frustoconical part 34, these ribs 40 form interposition overthicknesses between the free end 7A of the driving-in member 7 and the frustoconical part 34, as this is well visible in FIG. 9. The result of this is that, by means of the ribs 40, the respective free ends of the three aforementioned portions of the breakable part 28, in other words the terminal parts of these portions which, before their separation, formed together the bottom wall 30, are moved further away transversely from the axis X-X, thereby limiting the risk that, subsequently, upon removing the driving-in member 7 relatively to the plug 1, surface irregularities of the latter, such as the aperture 8 or the shouldered area between the free ends 7A and the running portion 7B, do not catch and thereby jam with the free ends of the aforementioned peripheral portions of the breakable part 28. This proper outward separation effect of the aforementioned portions, due to the ribs 40, is added to the similar effect obtained by the interference between the driving-in member 7 and the connecting portion 36 belonging to the side wall 32.

Various arrangements and alternatives to the plug 1 described up to now may moreover be contemplated. As examples:

- the protruding dimension of the ribs 40, i.e. their height measured relatively to the upper face 34A of the side wall 34, may, as in an alternative not shown, not be identical for all the present ribs; thus, according to a possible embodiment, both ribs associated with a same breaking line 38 have the same protruding dimensions, the three protruding dimensions respectively associated with the three pairs of ribs, having different values from each other;
- also as an alternative not shown, rather than being associated with two ribs, each breaking line 38 may only be associated with a single rib; thus, as an example forming an alternative of the plug 1 considered in the figures, three ribs, respectively associated with three breaking lines 38, alternate with these breaking lines around the axis X-X;

of course, the number of breaking lines 38 is not limited to three, but may also be equal to two or else be greater than or equal to four;

in the exemplary embodiment considered in the figures, each of the ribs 40 runs over the whole axial extent of the frustoconical part 34, which has the advantage of guaranteeing application of the invention for very diverse shapes of the driving-in member 7; this being said, the longitudinal dimension of the ribs may be provided to be shorter, the ribs then being preferably located closer to the top axial end of the frustoconical part 34; and/or embodiments other than the ribs 40 may be contemplated as protrusions on the surface 34A, against which the driving-in member 7 bears and then rubs, while globally running along the breaking lines 38; thus, each rib 40 may be replaced by a material bulge, with less defined contours than those of the ribs shown in the figures.

The invention claimed is:

1. A plug for closing a neck of a container, the plug comprising:

a cap for covering the neck, such that when the plug is on the neck for closing the neck, the cap extends across an inner aperture of the neck, and wherein the cap is adapted to be crossed by a driving-in member, and a skirt for attachment to the neck, the skirt being tubular and centered on an axis, extending axially from the cap and disposed around the neck when the plug is on the neck for closing the neck, wherein the cap defines a cavity for receiving the driving-in member, the cavity being substantially centered on the axis and having a bottom region that is delimited by a breakable part of the cap, wherein the breakable part is adapted to abut the driving-in member before the breakable part breaks, while a remainder of the cavity is delimited by a tubular part of the cap that connects the breakable part to the remainder of the cap and that is adapted to receive the driving-in member, wherein the breakable part includes a bottom wall extending across the axis and a side wall that connects the bottom wall to the tubular part and that is provided with breaking lines extending radially to the axis, and wherein the side wall of the breakable part of the cap has, on a surface of the side wall facing the cavity, at least one protrusion for supporting the driving-in member, the protrusion extending along one of the breaking lines.

2. The plug according to claim 1, wherein the at least one protrusion includes a plurality of protrusions so that each of the breaking lines is associated with at least a respective one of the plurality of protrusions.

3. The plug according to claim 1, wherein the at least one protrusion includes at least two protrusions provided on either side of at least one of the breaking lines.

4. The plug according to claim 1, wherein said at least one protrusion is located a distance apart from the associated breaking line.

5. The plug according to claim 1, wherein the at least one protrusion includes a rib having a length extending along one of the breaking lines.

6. The plug according to claim 5, wherein the at least one protrusion consists of the rib.

7. The plug according to claim 5, wherein the length of the rib extends radially to the axis.

8. The plug according to claim 5, wherein the length of the rib extends parallel to the associated breaking line.

9. The plug according to claim 1, wherein the side wall of the breakable part of the cap includes a frustoconical part that is substantially centered on the axis and that converges towards the bottom wall, and that bears a raised portion.

10. The plug according to claim 9, wherein the side wall of the breakable part of the cap consists of the frustoconical part.

11. The plug according to claim 9, wherein the at least one protrusion extends at least partially between opposite axial ends of the frustoconical part.

12. The plug according to claim 11, wherein the at least one protrusion extends entirely from one of the axial ends of the frustocononical part to the other.

13. The plug according to claim 1, wherein each breaking line extends radially, to at least the axis via the bottom wall and extends to an area where the side wall is connected to the tubular part.

* * * * *